US006164410A

United States Patent [19]

Linsbauer et al.

[11] Patent Number: 6,164,410

[45] Date of Patent: Dec. 26, 2000

[54] EXHAUST GAS MUFFLER

[75] Inventors: Peter Linsbauer, Remshalden; Jochen Kramer, Waiblingen; Peter Bauer, Winnenden, all of Germany

[73] Assignee: Andreas Stihl AG & Co., Germany

[21] Appl. No.: 09/478,981

[22] Filed: Jan. 6, 2000

[30] Foreign Application Priority Data

Jan. 7, 1999 [DE] Germany ..... 299 00 101 U

[51] Int. Cl.[7] ..... B21J 35/00

[52] U.S. Cl. ..... 181/230; 84/240; 84/231

[58] Field of Search ..... 181/230, 231, 181/264, 268, 269, 270, 282, 240

[56] References Cited

U.S. PATENT DOCUMENTS

| | | | |
|---|---|---|---|
| 3,482,649 | 12/1969 | Murphy | 181/240 |
| 5,177,962 | 1/1993 | Hall et al. | 60/311 |
| 5,712,455 | 1/1998 | Wagner | 181/238 |
| 5,866,859 | 2/1999 | Karlsson et al. | 181/230 |
| 5,883,342 | 3/1999 | Wolpert | 181/230 |
| 6,076,732 | 6/2000 | Schumacher et al. | 181/282 |

*Primary Examiner*—Robert E. Nappi
*Assistant Examiner*—Kim Lockett
*Attorney, Agent, or Firm*—Robert W. Becker & Associates

[57] ABSTRACT

An exhaust gas muffler for an internal combustion engine, especially in a manually guided implement such as a power chain saw and the like, is provided. The muffler has a housing having an inlet opening and an outlet for engine exhaust gas. An essentially cylindrical spark killer screen is fixed in position at a wall opening of the muffler housing that forms the outlet. The spark killer screen projects into the interior of the muffler housing. Adjoining the spark killer screen on the outer side of the muffler housing as an extension of the cylindrical spark killer screen is an exhaust gas pipe. This pipe is provided with threads and serves as a fastening device with which the spark killer screen and the exhaust gas pipe, as a fire protector, are fixed in position in the wall opening of the muffler housing.

8 Claims, 3 Drawing Sheets

EXHAUST GAS MUFFLER

BACKGROUND OF THE INVENTION

The present invention relates to an exhaust gas muffler for an internal combustion engine, especially in a manually guided implement such as a power chain saw and the like. The muffler has a housing with an inlet opening and an outlet for the engine exhaust gas, with an essentially cylindrical spark killer screen being fixed in position at a wall opening of the muffler housing that forms the outlet. The spark killer screen projects into the interior of the muffler housing and is adjoined on the outer side of the muffler housing by an exhaust gas pipe that is disposed in the extension of the cylindrical spark killer screen.

U.S. Pat. No. 3,798,769 discloses an exhaust gas muffler that is disposed in the exhaust gas circuit of an internal combustion engine for the tool drive in a chain saw. The muffler housing has an inlet opening and an outlet for the engine exhaust gas. A cylindrical dampening element that has numerous holes is mounted at the outlet of the exhaust gas muffler and projects into the interior thereof. The dampening element includes a similarly cylindrical spark killer screen. The dampening element and the spark killer screen each have a collar that rests against the muffler housing. A mounting plate and an exhaust gas pipe are held by two bolts on the muffler housing and in this manner clamp the respective collar from the outside against the muffler housing.

With the known exhaust gas muffler, as a function of the manner of operation of the internal combustion engine, there exists the danger that oil and tar from the exhaust gas can condense on the dampening element and on the spark killer screen. The oil and tar then exit the muffler with the exhaust gas stream in the form of drops and make both the muffler and the area surrounding the outlet dirty. In addition, carbon deposits can form on the spark killer screen and on the dampening element, thus adversely affecting the operation of the internal combustion engine.

It is therefore an object of the present invention to improve an exhaust gas muffler of the aforementioned general type in such a way that while maintaining a homogeneous exhaust gas stream, a fire protector is provided that can be easily mounted on the exhaust gas muffler without additional connecting means.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
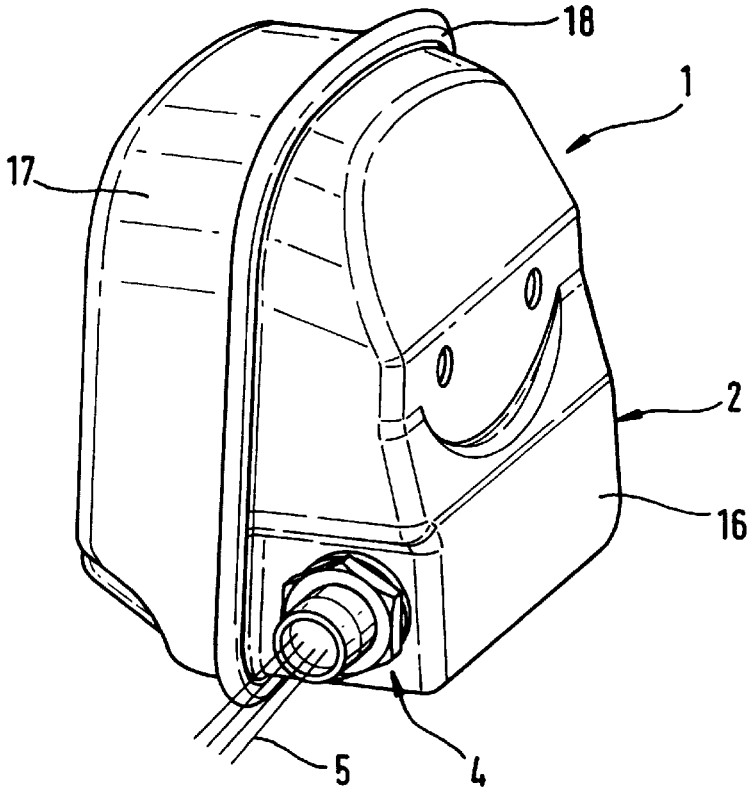
FIGS. 1 and 2 are each perceptive views of one exemplary embodiment of an inventive exhaust gas muffler.

The exhaust gas muffler of the present invention is characterized primarily in that the exhaust gas pipe is provided with threads that serve as fastening means with which the spark killer screen and the exhaust gas pipe, as a fire protector, are fixed in position in the wall opening of the muffler housing.

Pursuant to the present invention, the muffler housing comprises two shell parts that are joined at a common flange plane. In this flange plane, each of the shell parts has a circumferential rim, with these rims resting against one another in the mounting plane. When the muffler housing is closed, at least one partition is fixed between the shell parts with adequate preloading in its position within the muffler housing.

By rolling-in, folding or the like, the flange rims of the shell parts are interconnected and the muffler housing is tightly closed off. Pursuant to one preferred specific embodiment of the inventive exhaust gas muffler, outlet channels are formed in the partition for guiding the exhaust gases to the outlet of the muffler housing. Disposed at the outlet is a component in the form of a fire protector that comprises an exhaust gas pipe and a spark killer screen; this fire protector is threaded from the outside into the muffler housing. The exhaust gas pipe is advantageously embodied as a threaded connector so that together with the spark killer screen it can be threaded into a threaded sleeve that is inserted into the outlet of the muffler housing. The spark killer screen is positioned relative to the outlet channels of the partition in such a way that the hot exhaust gases cannot pass directly to the spark killer screen, thus precluding a burning up or incineration of the spark killer screen.

Depending upon the manner of operation of the internal combustion engine, however, deposits can result at the spark killer screen. Pursuant to the present invention, however, in such a case the spark killer screen can easily be replaced by screwing the fire protector out of the outlet of the muffler housing. Pursuant to one possibility the spark killer screen can be detachably connected with the exhaust gas pipe via a frictionally releasable connection. With such an embodiment of the fire protector, the spark killer screen can be released from the exhaust gas pipe and replaced. As another possibility, the spark killer screen can be fixedly connected with the exhaust gas pipe, for example by being soldered or welded therewith. With such an embodiment of the fire protector, if it becomes necessary the entire fire protector can be screwed out of the outlet of the muffler and replaced. By means of the screw connection of the fire protector with the outlet of the muffler housing, which screw connection can be controlled from the outside, an easy to service and structurally straightforward possibility is provided for installing and removing a fire protector on an exhaust gas muffler.

Pursuant to one preferred specific embodiment, the fire protector has a cylindrical configuration. As a consequence of such a configuration, the exhaust gases are accelerated in the interior of the fire protector and fewer liquid and solid constituents of the exhaust gas, such as oil, fuel and soot particles, can deposit on the spark killer screen. Thus, the exhaust gas stream causes less dirt to accumulate on the exterior of the muffler housing than was possible with heretofore known exhaust gas mufflers.

Further specific features of the present invention will be described in detail subsequently.

DESCRIPTION OF PREFERRED EMBODIMENTS

Figure 2:
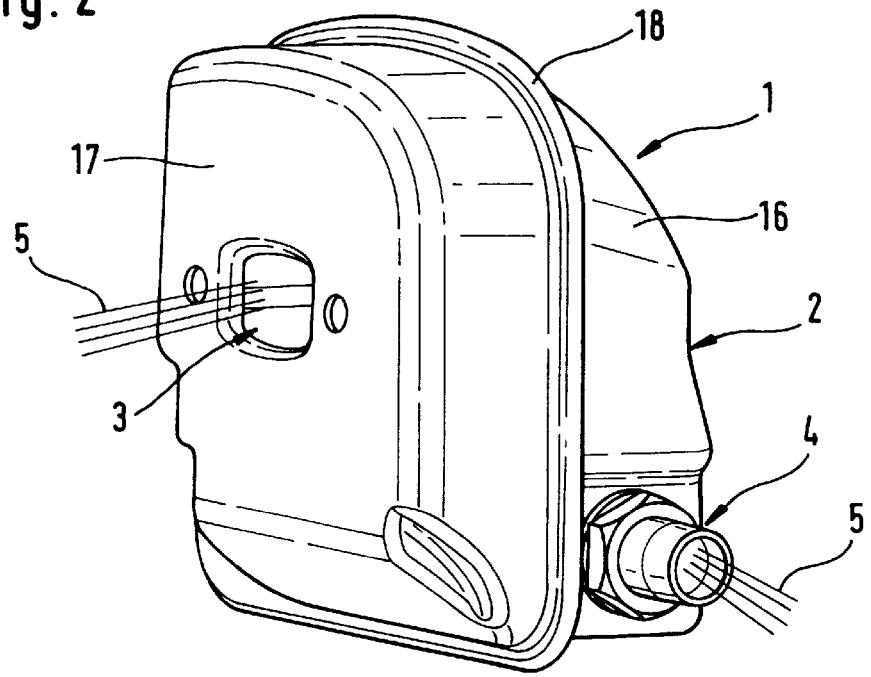

Referring now to the drawings in detail, the exhaust gas muffler 1 illustrated in FIGS. 1 and 2 is intended for use in the exhaust gas line of an internal combustion engine for reducing the operating noise of the engine. It is provided in particular for dampening the noise of internal combustion engines used to operate a tool of manually guided implements such as chain saws and the like. Such implements and corresponding internal combustion engines are known and will therefore not be described in detail. The exhaust gas muffler 1 is expediently disposed close to the outlet or exhaust of the internal combustion engine in order to dampen the pressure pulses in the exhaust gas stream. The exhaust gas 5 of the engine is introduced into the muffler housing 2 via an inlet opening 3, and leaves the housing 2 in a pulsation free manner via an outlet 4, resulting in a reduction of the generation of noise in the exhaust gas stream of the internal combustion engine.

The muffler housing 2 comprises two shell parts 16, 17. These shell parts are produced as drawn pieces from sheet metal, and are each provided on their open side with a circumferential rim 18. To assemble the muffler housing 2, the shell parts 16, 17 are joined in the common flange plane 19 (FIG. 3), whereby the rims 18 rest against one another. The flange parts 16, 17 are expediently fixedly connected such that they are circumferentially sealed by folding or rolling-in of the rims 18.

Figure 3:
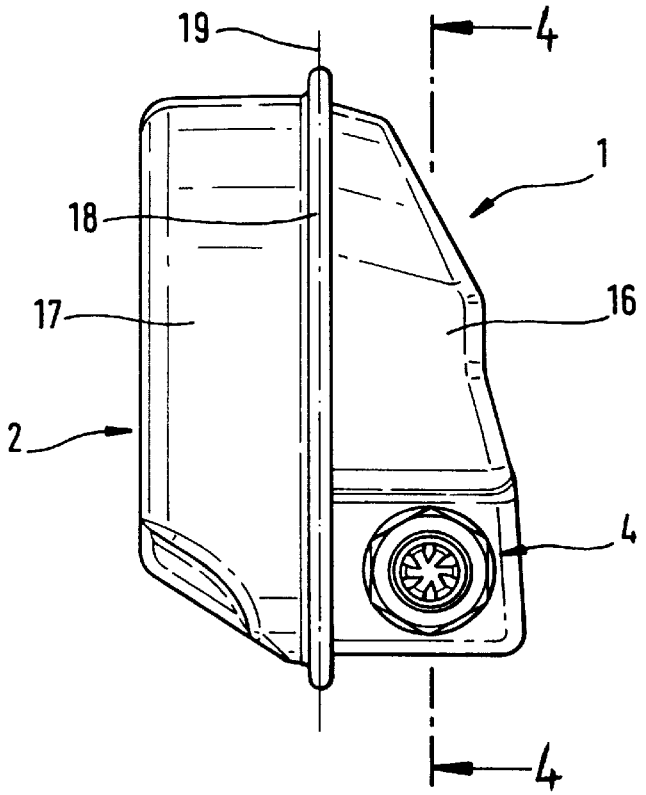
FIG. 3 is a side view of one exemplary embodiment of an inventive exhaust gas muffler.
Figure 4:
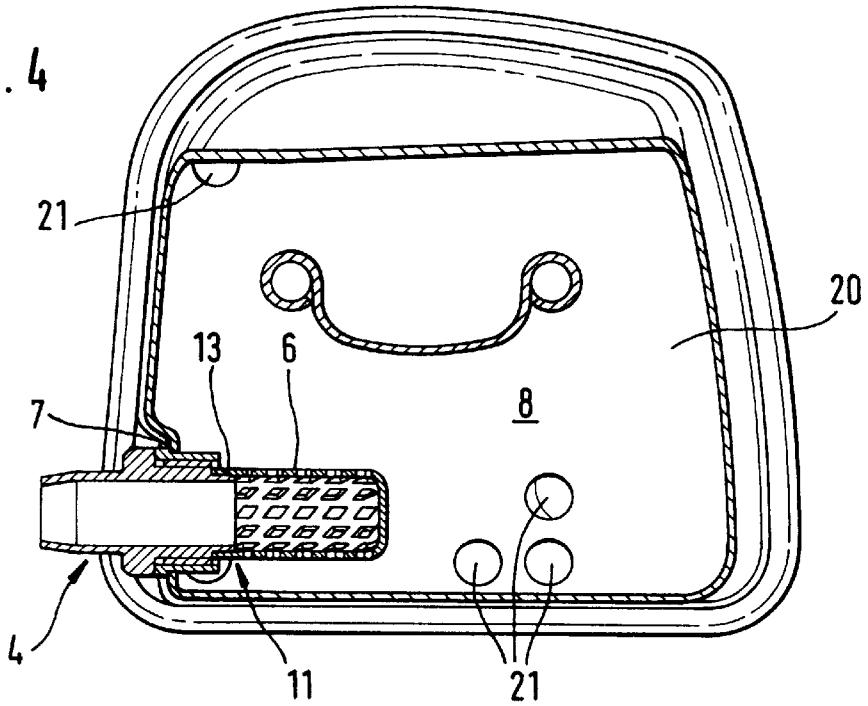
FIG. 4 is a longitudinal cross-sectional view taken through the exhaust gas muffler of FIG. 3 along the line 4-4 thereof.

FIG. 3 shows a side view of the exhaust gas muffler 1, with a cross-section taken along the line 4—4 providing the illustration of FIG. 4.

The internal construction of the exhaust gas muffler 1 is shown in FIG. 4. A partition 20 is disposed in the muffler housing 2 in the flange plane 19 between the shell parts 16, 17. Although the partition 20 divides the interior 8 of the muffler housing 2, the housing chambers on both sides of the partition 20 are interconnected in a fluidic manner via openings 21 for the transfer of the exhaust gas 5. The inlet opening 3 is formed in the half shell part 17 for the pulsating exhaust gas stream 5 of the internal combustion engine that is to be dampened. The exhaust gases 5 flow from the inlet opening 3 through the muffler housing 2 and are introduced via the openings 21 to both sides of the partition 20 into the interior 8 of the muffler housing 2. The exhaust gas 5 is guided out of the muffler housing 2 at the outlet 4, which is disposed in the half shell part 16 at approximately the opposite end of the housing 2 from the inlet opening 3. In going from the inlet opening 3 to the outlet 4, the exhaust gas 5 must pass the fire protector 11. This fire protector includes a spark killer grate or screen 6, which is preferably secured to an exhaust gas pipe by means of a roll-weld seam 13.

Figure 5:
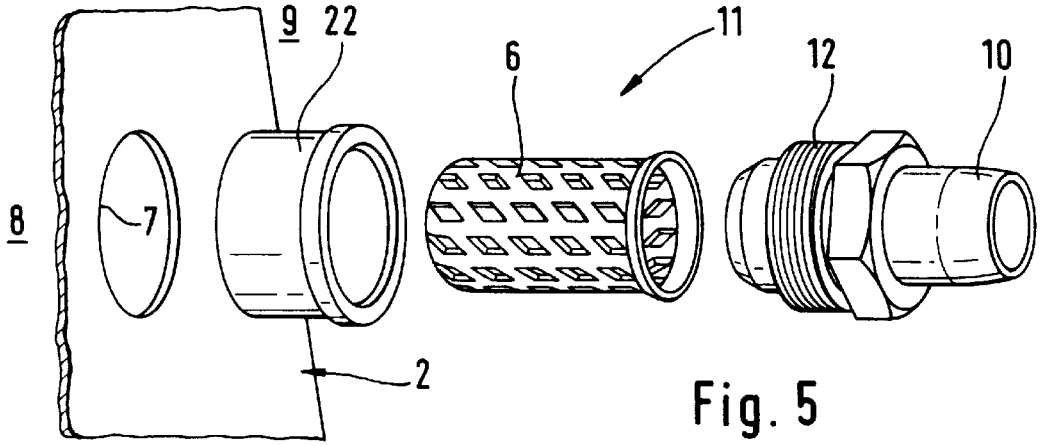
FIG. 5 is an exploded perspective view of one exemplary embodiment of the inventive fire protector.

FIG. 5 is a perspective, exploded view of one exemplary embodiment of a fire protector 11. This fire protector essentially comprises the components of exhaust gas pipe 10, with threads 12, and the spark killer screen 6, which are fixed in position in the wall opening 7 of the muffler housing 2 in a threaded sleeve 22.

Figure 6:
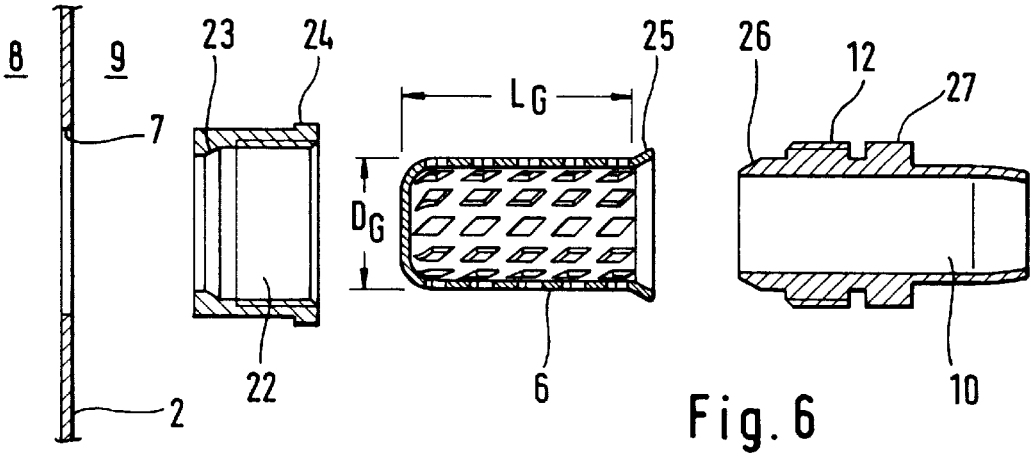
FIG. 6 is a longitudinal cross-sectional view through the elements of the fire protector of FIG. 5.

The longitudinal cross-sectional view of the fire protector 11 in FIG. 6 clearly shows the cooperation of the individual components. The threaded sleeve 22 can be introduced into the wall opening 7 by means of a clearance fit until the outer shoulder 24 of the sleeve 22 abuts against the muffler housing 2; the sleeve 22 can then be soldered or welded in place. The inner shoulder 23 of the threaded sleeve 22 in turn serves as an abutment for the flange 25 of the spark killer screen 6. The exhaust gas pipe 10 has a forward beveled edge 26. The flange 25 of the spark killer screen 6 is retained between the beveled edge 26 and the outer shoulder 24 of the threaded sleeve 22. In the illustrated embodiment, the spark killer screen 6 has an axial length $L_G$ that is approximately 1.5 times the diameter $D_G$. However, a larger ratio is also possible, in which connection an expedient range of $L_G$:$D_G$ of upto about 2.5; 1 could be considered.

Figure 7:
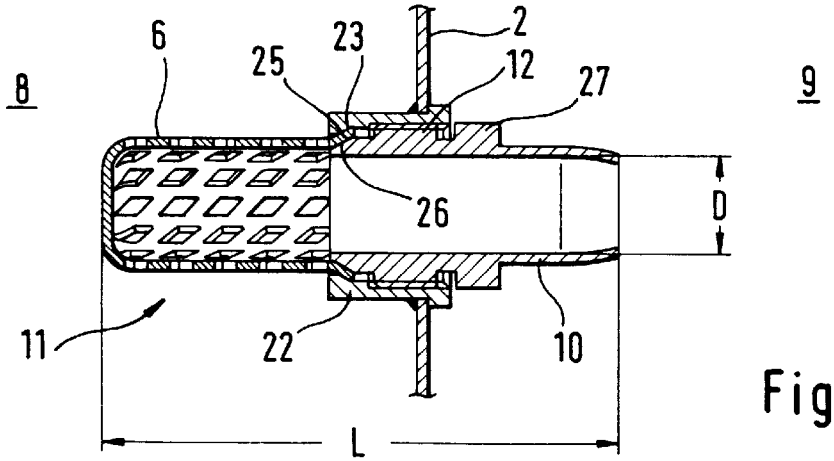
FIG. 7 is a longitudinal cross-sectional view through a fire protector built into the wall of an exhaust gas muffler.

The longitudinal cross-sectional view of FIG. 7 through a fire protector 11 illustrates the installed condition thereof. The threaded sleeve 22 is fixed in position in the wall opening 7 of the muffler housing 2 via a solder or weld connection. With the spark killer screen 6 inserted into the threaded sleeve 22, the flange 25 of the spark killer screen 6 rests against the inner shoulder 23 of the threaded sleeve 22. By means of the hexagonal collar 27, the threads 12 of the exhaust gas pipe 10 can be screwed into the threaded sleeve 22. A clamping or wedging connection for the spark killer screen 6 is formed by the beveled edge 26 of the exhaust gas pipe 10 together with the inner shoulder 23 of the threaded sleeve 22. Thus, by means of a single threaded connection, the fire protector 11 can be easily attached and removed from the muffler housing 2 from the outside.

The fire protector 11 is advantageously formed as a long, narrow cylinder. As a consequence, the engine exhaust gases 5 are accelerated prior to discharge from the muffler housing 2. As a result, deposits are avoided at the spark killer screen 6, and the exhaust gas stream does not cause any dirt to accumulate upon the outer side 9 of the muffler housing 2 due to possible back flow. As can be seen from FIG. 7, the fire protector 11, which is comprised of the spark killer screen 6 and the exhaust gas pipe 10, has a greater length L, whereby in the illustrated embodiment the length L is approximately 5 times the inner diameter D.

The specification incorporates by reference the disclosure of German priority document 299 00 101.6 of Jan. 7, 1999. The present invention is, of course, in no way restricted to the specific disclosure of the specification and drawings, but also encompasses any modifications within the scope of the appended claims.

What we claim is:

1. An exhaust gas muffler for an internal combustion engine, comprising:

a muffler housing having an inlet opening and an outlet for engine exhaust gas; and a fire protector disposed at said outlet of said muffler housing for receiving exhaust gas therefrom, wherein said fire protector includes an exhaust gas pipe that is provided with threads for being threaded to said muffler housing at said outlet, and wherein a spark killer screen is held by said exhaust gas pipe such that said spark killer screen extends into an interior of said muffler housing.

2. An exhaust gas muffler according to claim 1, wherein said spark killer screen of said fire protector is connected to said exhaust gas pipe in a positively engaging manner and is separable from said exhaust gas pipe.

3. An exhaust gas muffler according to claim 1, wherein said spark killer screen of said fire protector is frictionally connected with said exhaust gas pipe and is separable therefrom.

4. An exhaust gas muffler according to claim 1, wherein said spark killer screen of said fire protector is connected with said exhaust gas pipe by means of a roll welding seam.

5. An exhaust gas muffler according to claim 1, wherein said spark killer screen of said fire protector is soldered with said exhaust gas pipe.

6. An exhaust gas muffler according to claim 1, wherein said spark killer screen has an axial length $L_G$ that is approximately 1.5 to 2.5 times a diameter $D_G$ of said spark killer screen.

7. An exhaust gas muffler according to claim 1, wherein said fire protector is cartridge shaped and has a length L that is more than 5 times a diameter D thereof.

8. An exhaust gas muffler according to claim 1, wherein said exhaust gas pipe is provided with a hexagonal collar.

* * * * *